US007762393B2

(12) United States Patent
Schütz

(10) Patent No.: US 7,762,393 B2
(45) Date of Patent: Jul. 27, 2010

(54) TRANSPORT AND STORAGE CONTAINER FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 12/378,281

(22) Filed: Feb. 12, 2009

(65) Prior Publication Data

US 2009/0223847 A1 Sep. 10, 2009

(30) Foreign Application Priority Data

Feb. 16, 2008 (DE) ..... 10 2008 009 586

(51) Int. Cl.
*B65D 19/00* (2006.01)

(52) U.S. Cl. ..... 206/386; 220/9.4; 220/495.06

(58) Field of Classification Search ..... 206/386, 206/524.1–524.5; 220/1.5, 1.6, 9.4, 23.9, 220/23.91, 23.87, 23.89, 485, 495.06
See application file for complete search history.

(56) References Cited

U.S. PATENT DOCUMENTS 4,165,024 A * 8/1979 Oswalt et al. ..... 220/495.06
6,668,735 B2 * 12/2003 Cassina ..... 108/57.25
7,165,694 B2 * 1/2007 Schutz ..... 220/23.9
2004/0149610 A1 * 8/2004 Schutz ..... 206/386
2005/0092639 A1 * 5/2005 Schutz ..... 206/386
2005/0133514 A1 * 6/2005 Schutz ..... 206/386
2006/0272970 A1 * 12/2006 Przytulla ..... 206/386

FOREIGN PATENT DOCUMENTS

DE 202 17 856 3/2003

* cited by examiner

*Primary Examiner*—Luan K Bui
(74) *Attorney, Agent, or Firm*—Friedrich Kueffner

(57) ABSTRACT

A transport and storage container for liquids includes a parallelepiped-shaped or cubic inner container of plastic, a closable filling socket, and a draining socket for a draining fitting with a plastic housing, a flexible inner sheathing of plastic material which can be placed in the inner container and is provided with a filling socket, a discharge socket, an outer casing of metal grating or sheet metal and a pallet-like underframe for supporting the inner container. A threaded sleeve of plastic material is welded onto the drain socket of the inner container. When the filling socket of the fitting housing is screwed onto the threaded sleeve welded onto the connecting socket of the inner container, the sealing flange is clamped between the free end in the housing of the drain fitting of the threaded sleeve and an internal shoulder of the filling socket of the fitting housing, for sealing the connecting socket of the inner container and the threaded sleeve welded to the inner container and pulled through the drain socket by the internal sheathing.

8 Claims, 5 Drawing Sheets

TRANSPORT AND STORAGE CONTAINER FOR LIQUIDS

BACKGROUND OF THE INVENTION

1. Field of the Invention

The present invention relates to a transport and storage container for liquids, with a parallelepiped-shaped or cubic inner container of plastic, a closable filling socket arranged at an upper bottom, and a draining socket arranged in a lower portion of the front wall in the area of the lower bottom for a draining fitting with a plastic housing, a flexible inner sheathing of plastic material which can be placed in the inner container and is provided with a filling socket, a discharge socket, an outer casing of metal grating or sheet metal and a pallet-like underframe for supporting the inner container.

2. Description of the Related Art

The inner container of transport and storage containers of the above-described type, as they are described in DE 202 17 856.0 U1, is equipped for the transportation and storage of liquids of different types in the chemical, pharmaceutical, mineral oil, and food industries, with an exchangeable flexible inner sheathing of plastic material.

The stringent environmental laws make it necessary to stop using single-use containers, such as pallet containers and drums, for the transportation and storage of liquids of different types, and to use multiple-use containers having greater volumes with the goal of reducing the residual quantities, and to develop new multiple-use containers which, with a view to reducing the environmental burden of harmful substances on the environment, are reconditioned, and whose plastic components contaminated by the liquid material being transported and stored, can be reduced to a flexible inner sheathing of thin foil material. The contaminated inner sheathing can be disposed of in an optimum manner by destroying them by a process which is low in or even free of harmful materials, for example, by burning.

SUMMARY OF THE INVENTION

It is the primary object of the present invention to further develop the transport and storage container for liquids of the above-described type, such that a simple mounting of the discharge fitting, particularly a flap valve or circle valve is possible.

In accordance with the present invention, the transport and storage container for liquids includes a threaded sleeve of plastic material welded onto the drain socket of the inner container, wherein the welded sleeve has an external thread for screwing the housing of the drain fitting to the filling socket of the housing provided with a corresponding internal thread, wherein the flexible drain socket of the inner sleeve, which can be pulled through the connecting socket of the inner container and through the threaded sleeve welded to the connecting socket, and which is placed in the inner container from the top through the filling socket of the inner container into the inner container, has a sealing flange at the discharge end thereof, wherein the sealing flange, when the filling socket of the fitting housing is screwed onto the threaded sleeve welded onto the connecting socket of the inner container, is clamped in the housing of the drain fitting between the free end of the threaded sleeve and an internal shoulder of the filling socket of the fitting housing, for sealing the connecting socket of the inner container and the threaded sleeve welded to the inner container and pulled through the drain socket.

The transport and storage container according to the present invention has the following advantages:

The novel container construction facilitates a simple connection of the drain fitting manufactured as an injection molded piece of plastic to the drain socket of the inner sheathing and the drain socket of the inner container of the transport and storage container when the container is manufactured new and when it is reconditioned. The fitting can also be unscrewed easily for removing the inner sheeting from the inner container when reconditioning the transport container.

Since the inner sheathing can be simply exchanged after use, it can be offered for use as an insert in the multiple-use container, a clean inner container can be offered. The sealing flange with a sealing lip integrally formed at the drain socket of the inner sheathing makes it unnecessary to provide a separate sealing ring as it is conventionally used for sealing the drain socket of the inner container in the fitting housing. Since the drain fitting is screwed directly to the fill socket on the threaded sleeve welded to the connecting socket of the inner container, it is unnecessary to provide the cap nut for screwing the fitting to the drain socket of the inner container as it is otherwise conventional. The fact that the sealing ring and the cap do not have to be used makes it possible to reduce the manufacturing costs of the novel transport and storage container with internal sheathing for liquids.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
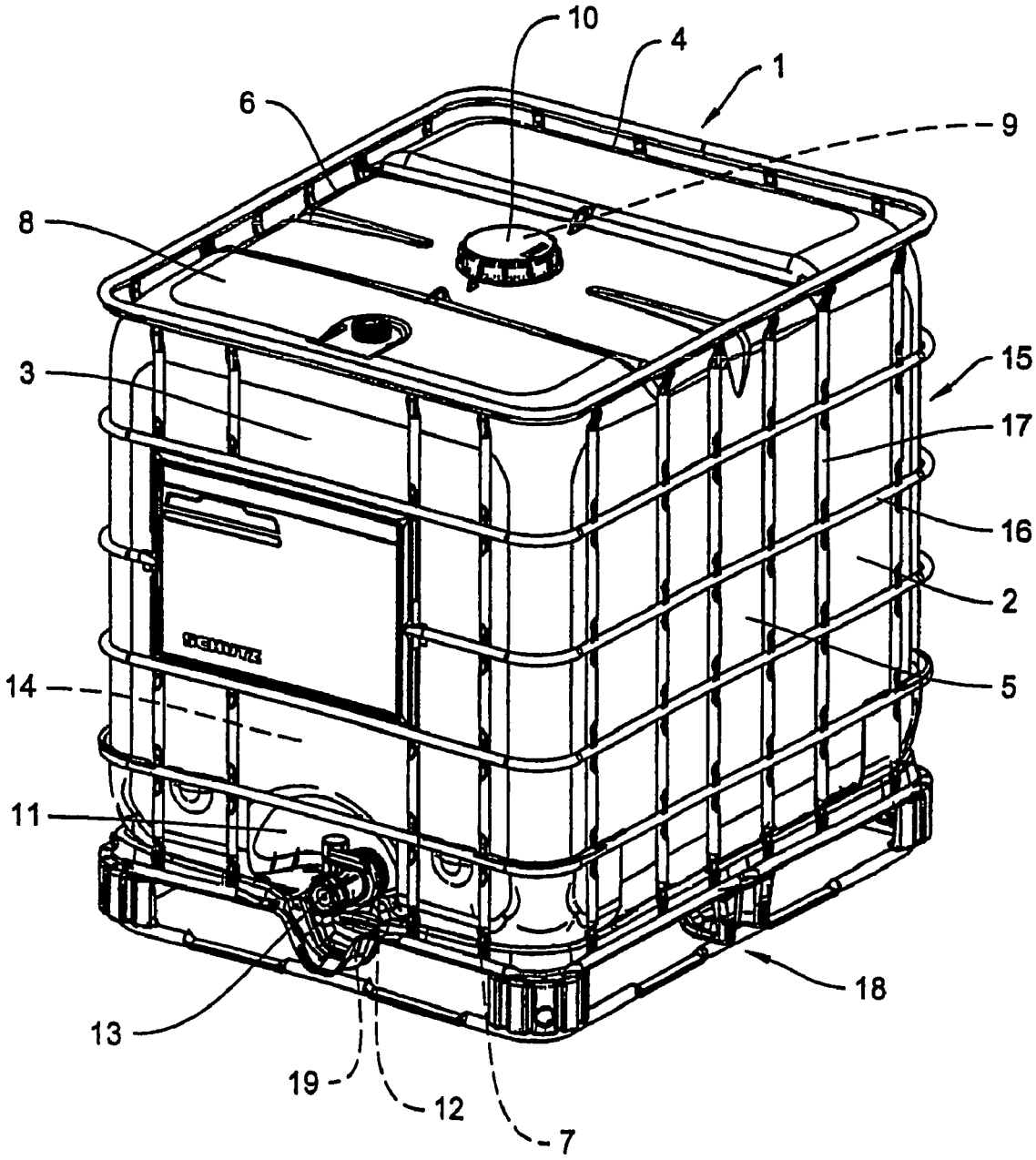
FIG. 1 is a perspective illustration of the transport and storage container.
Figure 2:
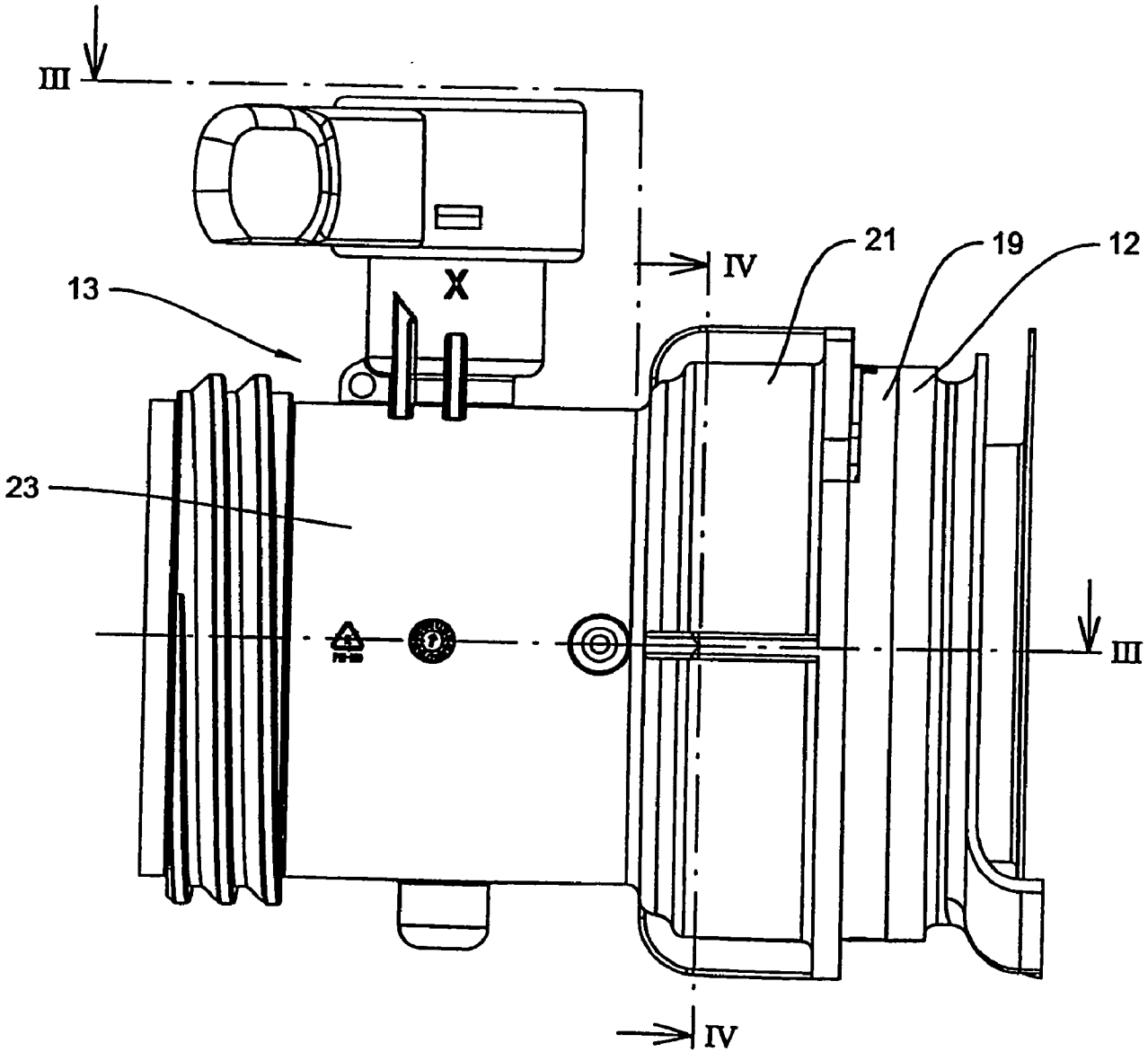
FIG. 2 is a side view of the drain fitting mounted on the connecting socket of the inner container.
Figure 3:
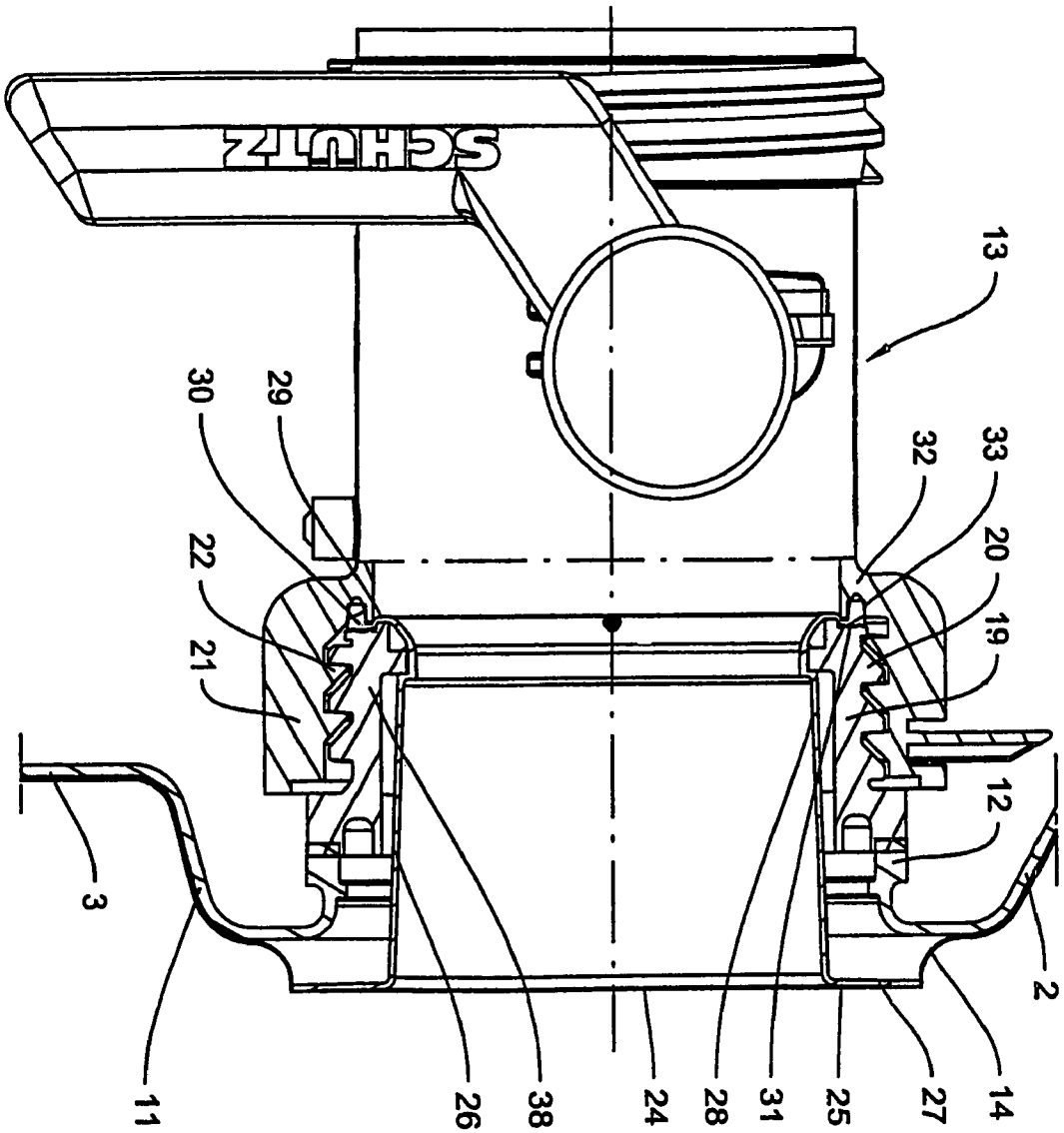
FIG. 3 shows a partial top view and a partial longitudinal sectional view of the drain fitting connected to the inner container, taken along line III-III of FIG. 2.
Figure 4:
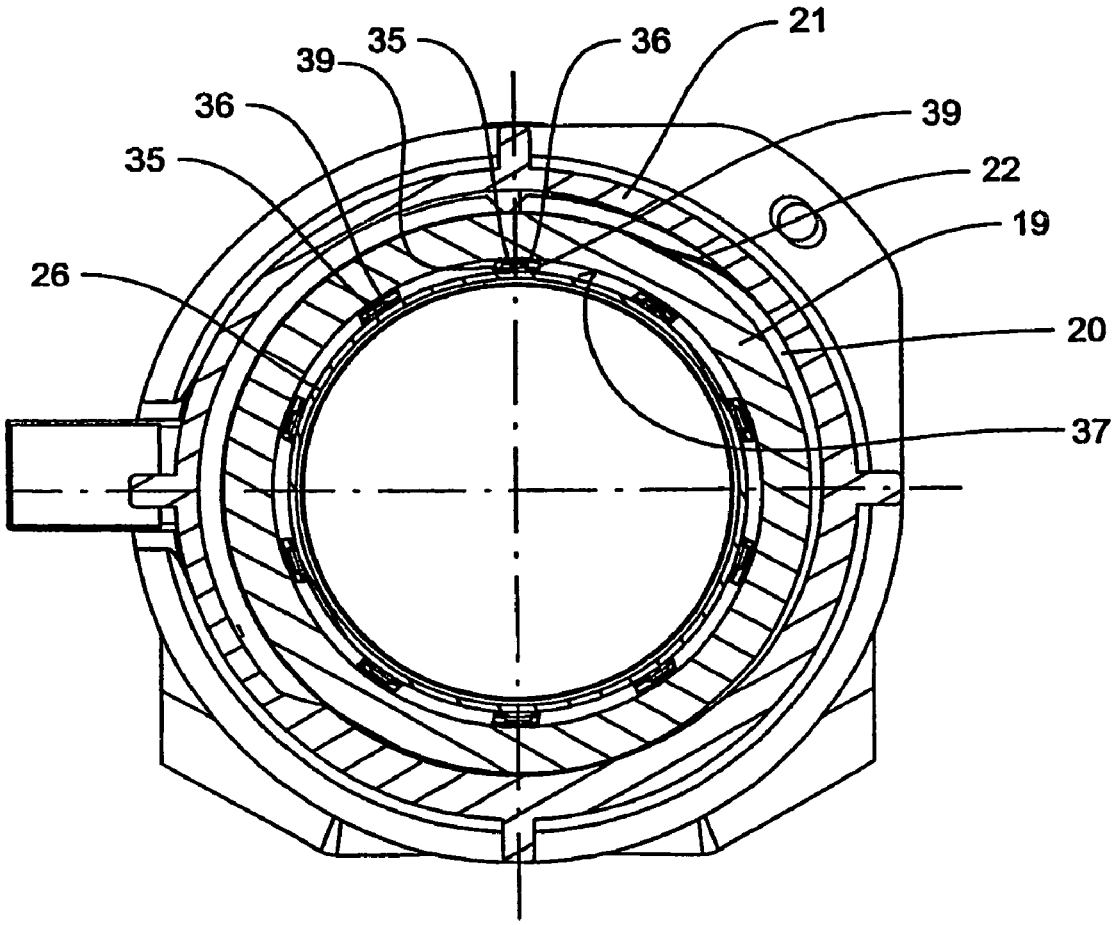
FIG. 4 is a cross-sectional view taken along IV-IV of FIG. 2.
Figure 5:
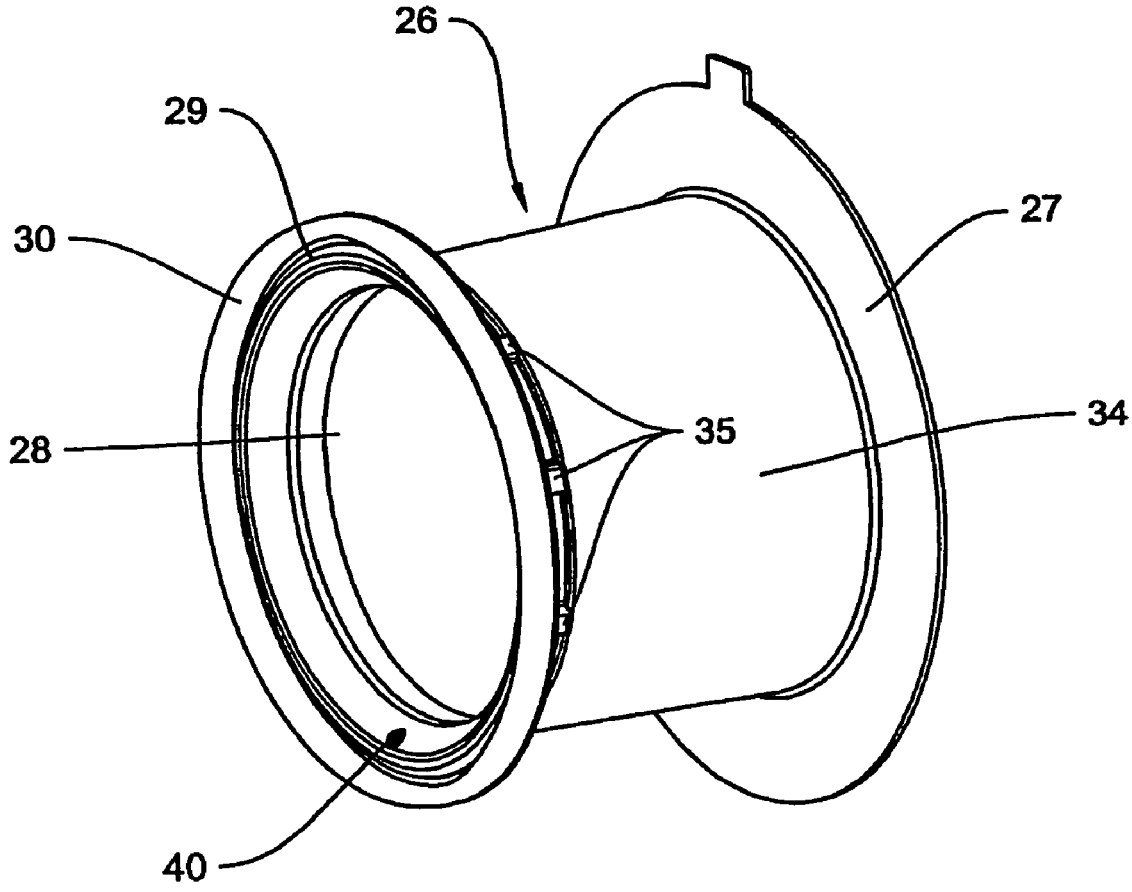
FIG. 5 is a perspective illustration, on a large scale, of the drain socket of the inner sealing of the transport and storage container.

The transport and storage container 1 for liquids used as a single-use and a multiple-use container illustrated in FIG. 1, includes as its principal structural components an exchangeable parallelepiped-shaped inner container 2 of plastic material with a front wall 3, a rear wall 4 and two side walls 5, 6, a lower bottom 7 constructed as a drainage bottom and an upper bottom 8, a fill socket 9 integrally formed at the upper bottom 8 and closable by means of a cover 10. The container further includes a connecting socket 12 integrally formed at an indentation 11 in the lower portion of the end wall 3, wherein the connecting socket 12 is manufactured as a single piece with the inner container by injection molding, wherein the drain fitting 13 is particularly a flap valve. A flexible inner sheathing 14 of plastic material is placed from above through the fill socket 9 into the inner container 2. The outer casing 15 is constructed of a grating material with intersecting horizontal and vertical grating rods 16, 17 of metal for receiving the inner container 2 as well as a pallet-like underframe 18 with length and width dimensions in accordance with industrial standards for supporting the inner container 2.

Welded to the connecting socket 12 of the inner container 2 is a threaded sleeve 19 with an external thread 20 for screwing on the fill socket 21 of the housing 23 of the drain fitting 13 which is provided with a corresponding internal thread 23. The threaded sleeve 19 is manufactured as an injection molded part of plastic material.

The inner sheathing 14 has a lower drain opening 24 onto whose rim 25 is welded a flexible drain socket 26 of plastic material with a flange 27. A flexible sealing flange 29 provided with an annular sealing lip 30 is integrally formed onto the draining end 28 of the draining socket 26 of the inner sheathing 14.

The inner sheathing 14 has a lower draining opening 24 to whose rim 25 is welded a flexible discharge socket 26 of plastic material with a flange 27. Integrally formed with the outlet end 28 of the discharge socket 26 of the inner sleeve 14 is a flexible sealing flange 29 which is provided with an annular sealing lip 30. The inner sheathing 14 is placed through the fill socket 9 from the top into the inner container 2 and the discharge socket 26 welded to the bottom of the inner sleeve 14 extends outwardly through the connecting socket 12 of the inner container 2 and the threaded sleeve 19 welded to the inner container 2. The sealing flange 29 of the drain socket 26 of the inner sheathing 14 is placed in contact with the free end face 31 of the threaded sleeve 19.

When the housing 23 of the drain fitting 13 is screwed with the fill socket 21 to the threaded sleeve 19 welded to the connecting socket 12 of the inner container 2, the sealing flange 29 of the drain socket 26 of the inner sleeve 14 is tensioned between the end face 31 of the threaded sleeve 19 and an inner shoulder 32 of the fill socket 21 of the inner sleeve 14 in the fitting housing 23. When tensioning the sealing flange 29 of the drain socket 26 of the inner sleeve 14, the sealing lip 30 of the sealing flange is pressed into an annular groove 33 in the inner shoulder 32 of the fill socket 21 of the fitting housing 23.

The drain socket 26 of the inner sheathing 14 is equipped with a lock against rotation which prevents a rotation of the drain socket 26 when the fitting housing 23 is welded with the fee socket 21 onto the connecting socket 12 of the inner container 2.

The lock against rotation is formed by knurls 35 formed on the outer surface 34 of the fitting 26 of the inner sheathing 14 in circumferential direction behind the sealing flange 29, wherein, when the drain socket 26 of the inner sheathing 14 is pulled through the connecting socket 12 of the inner container 2, the threaded sleeve 19 welded to the inner container 2 comes into engagement with corresponding grooves 36 in the threaded sleeve 19 welded to the inner container 2, wherein the knurls are arranged in the inner casing 37 of the threaded sleeve 19 at the front end 38 thereof in circumferential direction.

The knurls 35 and the two longitudinal sides 39 of the corresponding engagement groove 36 of the lock against rotation are beveled against the direction of turning the fitting housing 23.

Formed on the sealing flange 29 of the drain socket 26 of the inner sleeve 14 is a knurl 40 as an optical orientation aid for lining the drain circuit 26 of the inner sleeve 14 for a predetermined mounting position after the drain socket 26 has been pulled through through the connecting socket 12 of the inner container 2 and the threaded sleeve 19 welded thereto when the inner sleeve 14 is placed in the inner container 2.

While specific embodiments of the invention have been shown and described in detail to illustrate the inventive principles, it will be understood that the invention may be embodied otherwise without departing from such principles.

The invention claimed is:

1. A transport and storage container for liquids comprises a parallelepiped-shaped or cubic inner container of plastic, a closable filling socket arranged at an upper bottom, and a draining socket arranged in a lower portion of the front wall in an area of a lower bottom for a draining fitting with a plastic housing, a flexible inner sheathing of plastic material placed in the inner container and provided with a filling socket, a discharge socket, an outer casing of metal grating or sheet metal, and a pallet-like underframe for supporting the inner container, a threaded sleeve of plastic material welded onto the draining socket of the inner container, wherein the threaded sleeve has an external thread for screwing the housing of the draining fitting to the filling socket of the housing provided with a corresponding internal thread, wherein the draining socket which can be pulled through a connecting socket of the inner container and through the threaded sleeve welded to the connecting socket, wherein the flexible inner sheathing placed in the inner container from the top through the filling socket of the inner container into the inner container has a sealing flange at a discharge end thereof, wherein, when the filling socket of the housing of the draining fitting is screwed onto the threaded sleeve welded onto the connecting socket of the inner container, the sealing flange is clamped between the free end in the housing of the draining fitting of the threaded sleeve and an internal shoulder of the filling socket of the housing of the draining fitting, for sealing the connecting socket of the inner container and the threaded sleeve welded to the inner container and pulled through the draining socket by the inner sheathing.

2. The container according to claim 1, comprising means for locking rotation of the draining socket of the inner sheathing in the threaded sleeve welded to the connecting socket of the inner container.

3. The container according to claim 2, comprising knurls formed in circumferential direction behind the sealing flange on the outer surface of the discharge socket of the inner sheathing, wherein, when the draining socket of the inner sheathing is pulled through the connecting socket of the inner container and the threaded sleeve welded to the inner container, the knurls come into contact with corresponding grooves arranged in an inner surface of the threaded sleeve at a front end thereof in circumferential direction.

4. The container according to claim 3, wherein the knurls and two longitudinal sides of the corresponding grooves are bevelled against the turning direction for screwing on the housing of the draining fitting.

5. The container according to claim 1, wherein the sealing flange formed onto the discharge socket of the inner sheathing has an angular sealing lip which, when the housing of the draining fitting is screwed onto the threaded sleeve at the connecting socket of the inner container, is pressed in an angular groove in the internal shoulder of the filling socket for sealing the draining socket of the inner sheathing in the filling socket of the draining fitting.

6. The container according to claim 1, comprising an optical orientation aid mounted on the sealing flange of the draining socket of the inner sheathing for aligning the discharge socket of the inner sheathing for a predetermined mounting position after the draining socket has been pulled through the connecting socket of the inner container and the threaded sleeve welded to the inner container after the inner sheathing has been placed in the inner container.

7. The container according to claim 6, wherein the orientation aid is comprised of knurls formed onto the sealing flange of the draining socket of the inner sheathing.

8. The container according to claim 1, wherein the threaded sleeve welded onto the connecting socket of the inner container is an injection molded piece of plastic material.

* * * * *